US008674276B2

(12) United States Patent
Rovinsky

(10) Patent No.: US 8,674,276 B2
(45) Date of Patent: Mar. 18, 2014

(54) DEFENSE SYSTEM

(75) Inventor: Jacob Rovinsky, Modiin (IL)

(73) Assignee: Israel Aerospace Industries Ltd., Lod (IL)

( * ) Notice: Subject to any disclaimer, the term of this patent is extended or adjusted under 35 U.S.C. 154(b) by 248 days.

(21) Appl. No.: 13/052,498

(22) Filed: Mar. 21, 2011

(65) Prior Publication Data

US 2011/0226889 A1 Sep. 22, 2011

(30) Foreign Application Priority Data

Mar. 21, 2010 (IL) ..... 204620

(51) Int. Cl.

| | |
|---|---|
| ***F42B 15/01*** | (2006.01) |
| ***F41G 7/20*** | (2006.01) |
| *F42B 15/00* | (2006.01) |
| *F41G 7/00* | (2006.01) |

(52) U.S. Cl.

USPC ..... 244/3.15; 244/3.1; 244/158.1; 89/1.11

(58) Field of Classification Search

USPC ..... 244/3.1–3.3, 158.1, 158.4, 158.6, 244/158.7; 89/1.11, 36.01; 342/1–20, 159, 342/160, 162, 175, 192–197; 398/140, 151; 102/430, 438

See application file for complete search history.

(56) References Cited

U.S. PATENT DOCUMENTS

| | | | | |
|---|---|---|---|---|
| 3,150,363 | A * | 9/1964 | Finvold | 398/151 |
| 3,229,290 | A * | 1/1966 | Fisher | 342/12 |
| 3,290,681 | A * | 12/1966 | Beteille | 342/11 |
| 3,671,965 | A * | 6/1972 | Rabenhorst et al. | 342/8 |
| 3,982,713 | A * | 9/1976 | Martin | 244/3.1 |
| 4,415,898 | A * | 11/1983 | Gaunaurd et al. | 342/192 |
| 4,695,841 | A * | 9/1987 | Billard | 342/8 |
| 4,817,495 | A * | 4/1989 | Drobot | 89/1.11 |
| 5,053,622 | A * | 10/1991 | Kessler | 89/1.11 |
| 5,249,527 | A * | 10/1993 | Schwind | 89/1.11 |
| 5,424,741 | A * | 6/1995 | Genovese | 342/10 |
| 5,611,502 | A * | 3/1997 | Edlin et al. | 244/3.16 |
| 5,657,251 | A * | 8/1997 | Fiala | 342/162 |
| 6,107,952 | A * | 8/2000 | Barker et al. | 342/13 |
| 6,178,865 | B1 * | 1/2001 | Roberts | 89/36.01 |
| 6,231,003 | B1 * | 5/2001 | Hibma et al. | 244/3.22 |
| 6,507,307 | B1 * | 1/2003 | Huber, Jr. | 342/13 |
| 6,626,077 | B1 * | 9/2003 | Gilbert | 89/1.11 |
| 6,650,269 | B1 * | 11/2003 | Huber, Jr. | 342/13 |
| 6,830,222 | B1 * | 12/2004 | Nock et al. | 244/158.7 |
| 6,833,804 | B2 * | 12/2004 | Atar | 89/1.11 |
| 6,877,691 | B2 | 4/2005 | DeFlumere et al. | |
| 7,137,588 | B2 * | 11/2006 | Humphrey | 244/3.15 |
| 7,631,600 | B2 * | 12/2009 | O'Dwyer | 102/438 |
| 7,886,646 | B2 * | 2/2011 | Bannasch et al. | 89/1.11 |
| 7,916,065 | B1 * | 3/2011 | Mintz et al. | 342/13 |
| 8,115,148 | B1 * | 2/2012 | Boardman et al. | 244/3.14 |
| 2006/0091255 | A1 * | 5/2006 | Wakefield | 244/3.1 |
| 2009/0000465 | A1 * | 1/2009 | Deflumere et al. | 89/1.11 |

FOREIGN PATENT DOCUMENTS

| | | | | |
|---|---|---|---|---|
| GB | 2121148 | A * | 12/1983 | F41H 13/00 |

* cited by examiner

*Primary Examiner* — Bernarr Gregory
(74) *Attorney, Agent, or Firm* — Oliff PLC

(57) ABSTRACT

An exo-atmospheric intercepting method for intercepting in space multiple objects, including acquiring and tracking multiple inflated objects which fly towards a protected territory. The method further includes launching an interceptor missile accommodating a plurality of kill vehicles each hosting a plurality of punching objects and classifying the multiple objects into clusters. In respect of each cluster of objects, determining an ejection condition responsive to meeting of which a kill vehicle is ejected from the interceptor missile towards the cluster of objects and thereafter releasing from the kill vehicle a plurality of punching objects such that every inflated object in the cluster is likely, with a high degree of certainty, to be punched by one or more punching objects.

24 Claims, 11 Drawing Sheets

Identical IR Signatures

Tate model for crater size estimation

- CRATER SIZE ESTIMATION
  - $U=[v-u(v^2+A)^{1/2}/(1-u)^2]$
  - $A=2(R_t-Y_p)(1-u^2)/p_t$

- $d_c=d_p[1+(2p_p(v-U)^2)/R_t]^{1/2}$
  - 84 $l_c=l_p/u^2\ ln(1+p_tV_c^2/2R_t)$

- $p_t$ =target density
  - $p_p$=projectile density
  - U=projectile interface velocity
  - v =velocity at projectile end
  - $Y_p$ = projectile strength
  - $R_t$ =resistance to target penetration
  - $u=(p_t/p_p)^{1/2}$

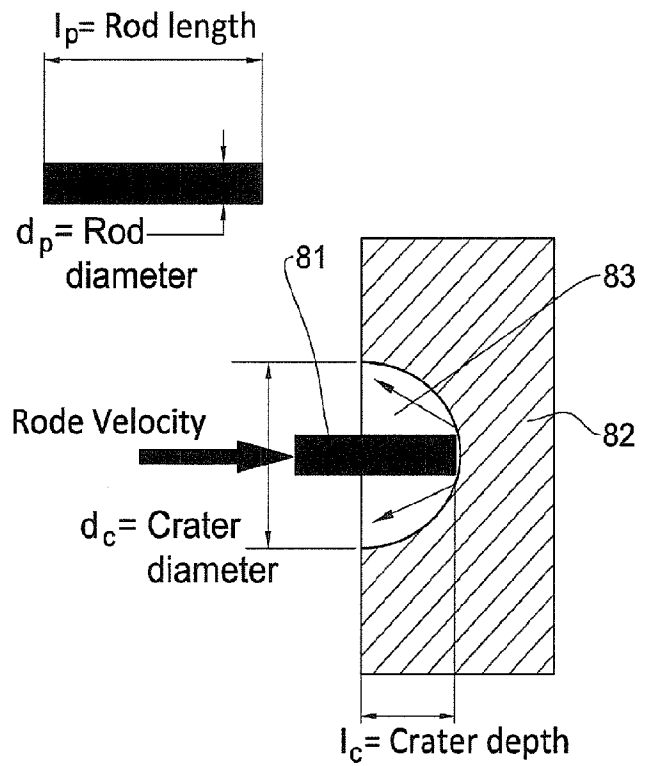

Ref: *"Physics of Direct Hit and Near Miss Warhead Technology"*, Richard M. Lloyd

Fig. 8B

DEFENSE SYSTEM

FIELD OF THE INVENTION

This invention relates to exo-atmospheric interception of inflatable flying objects.

BACKGROUND OF THE INVENTION

Ballistic missiles which hit a friendly territory have become a significant threat and accordingly tremendous efforts have been invested to develop interception measures which facilitate interception of the oncoming missile at various flight stages such as Boost phase, Exo-atmospheric phase or Atmospheric stage (when the Ballistic missile threat re-enters the atmosphere). Various approaches have been offered and systems have been developed in order to intercept the Ballistic missiles in space, before they enter the atmosphere. This trend led to the development of counter measures (CM) in order to hinder the intercepting missiles to hit and destroy ballistic missiles in space. Amongst the numerous proposed CMs are decoys integrated with Multiple Reentry Vehicles (MRV) that are accommodated in the attacking ballistic missile, of which a few may be decoys. Thus, in a typical scenario, a ballistic missile may release, at certain stage in space, multiple objects, a few of which may be warheads or others such as decoys. In accordance with advanced counter measure solutions, the released objects are inflatable. This has a few inherent advantages from the standpoint of the ballistic missile. Thus, the main ballistic missile platform may accommodate a plurality of objects in a relatively small volume considering the fact that the inflatable objects are each stored in a wrapped form of a small dimension within the missile. The inflatable objects are inflated to a larger dimension only upon release from the ballistic missile's compartment to space. In addition, inflatable objects are, naturally, of relatively low weight, thereby facilitating accommodation of a plurality of them in the constrained scenario of limited payload that is often posed on a ballistic platform that is launched to space. The net effect is thus that a single ballistic missile can release in space a plurality of flying objects. Considering further that the inflatable objects (some or all of which are decoys) can be a priori designed to have shape and flight dynamics that resemble a true warhead, it readily arises that the interceptor missile which is designated to kill the threat by a direct hit is faced with a significant challenge to discern between the decoys and true warhead threats and focuses on tracking and homing onto the real threats rather than the decoys. It is inherently assumed that even if the interceptor employs multiple kill vehicles (MKV) it does not employ enough vehicles to target each and every inflatable object, whether a decoy or a real threat, and therefore the need to discern between a decoy and a threat is so important.

A system of this kind that releases multiple inflatable objects is, for instance, the known Minitment US system.

In the last few years the Russians have introduced an even more advanced CM system (e.g. the Russian Topol-M system), where a few of the inflatable objects accommodate, each, a longitudinal warhead having smaller dimensions than that of the hosting inflatable object. Thus, even if a vehicle, from among the MKVs of the interceptor, successfully hits an inflatable object of the kind specified and punches it, the longitudinal warhead concealed therein will remain intact and will continue to fly in its designated flight trajectory towards the friendly territory, which is obviously undesired.

The introduction of CM solutions of the kind specified may lead to shifting the efforts of hitting the target missile in space and focus again on the boost and atmospheric stages. Whilst the focus on the specified boost and re-entry stages may achieve the desired results of intercepting a target missile (or its RVs), it is still desired to have an effective intercepting system which will facilitate successful interception in the space of a target ballistic missile that employs a plurality of inflatable objects. As is well known, utilizing an efficient multi-layer solution designed to destroy ballistic missile threats at boost phase or in space or in atmosphere re-entry stage is important in order to reduce the prospect of target leakage to substantially zero, considering the dire consequences that may occur if a target missile, e.g. employing nuclear warhead, hits a friendly territory. Accordingly, there is a need in the art to provide for a Counter-Counter measure (CCM) system which is capable of overcoming CM solutions of the kind specified.

There is still further need in the art to employ a CCM system which facilitates successful kill of attacking missiles which utilize a plurality of inflatable objects that are released in space and in which a few or all of the inflatable objects conceal therein a warhead targeted towards a protected area.

There is still further need in the art to provide for a two phase CCM system which in a first phase will destroy in space the inflatable objects and in a second phase will destroy the flying warheads that were concealed in the inflatable objects.

SUMMARY OF THE INVENTION

In accordance with an aspect of the invention there is provided an exo-atmospheric intercepting method for intercepting in space multiple objects, comprising (a) acquiring and tracking multiple inflated objects which fly towards a protected territory;

(b) launching an interceptor missile accommodating a plurality of kill vehicles each hosting a plurality of punching objects;

(c) classifying the multiple objects into at least one cluster;

(d) in respect of each cluster of objects, determining an ejection condition responsive to meeting of which a kill vehicle is ejected from the interceptor missile towards the cluster of objects and thereafter releasing from the kill vehicle a plurality of punching objects such that every inflated object in the cluster is likely, with a high degree of certainty, to be punched by at least one of the punching objects.

In accordance with an embodiment of the invention, there is provided a method, wherein the ejection condition includes orientation of the warhead towards the cluster.

In accordance with an embodiment of the invention, there is further provided a method wherein the ejection condition further includes determination of modified flight trajectory of the interceptor towards the cluster.

In accordance with an embodiment of the invention, there is further provided a method wherein the ejection condition further includes evaluation of volume uncertainty.

In accordance with an embodiment of the invention, there is still further provided a method wherein the ejection condition further includes evaluation of time uncertainty.

In accordance with an embodiment of the invention, there is still further provided a method, wherein the interceptor employs an Attitude Control System (ACS) that facilitates rotation of the interceptor, constituting a further parameter of ejection condition.

In accordance with an embodiment of the invention, there is still further provided a method, wherein the ejection condition prescribes the release timing of the punching object from the kill vehicle.

In accordance with an embodiment of the invention, there is still further provided a method, wherein (c) includes utilizing an external station for classifying the multiple objects into at least one cluster and communicating the cluster data to said interceptor missile.

In accordance with an embodiment of the invention, there is still further provided a method, wherein (d) includes utilizing an external station for determining the ejection condition and communicating the ejection condition data to the interceptor missile, for ejecting the kill vehicle responsive to meeting the ejection condition.

In accordance with an embodiment of the invention, there is still further provided a method, wherein (c) is performed in the interceptor missile.

In accordance with an embodiment of the invention, there is still further provided a method, wherein determining the ejection condition is performed in the interceptor missile.

In accordance with an embodiment of the invention, there is still further provided a method, wherein the at least one of inflatable objects accommodates a Reentry Vehicle (RV), such that the flight characteristics of the at least one inflatable object resemble the flight characteristics of another inflatable object that does not accommodate an RV.

In accordance with an embodiment of the invention, there is still further provided a method, wherein the punching object being longitudinal fiber optics having a density larger than the density of the surface of the inflatable object.

In accordance with an embodiment of the invention, there is still further provided a method, wherein the classifying includes, determining at least two objects that are launched from a given platform and classifying them to a cluster of objects.

In accordance with an embodiment of the invention, there is still further provided a method, wherein the determining includes performing backtracking to the at least two objects in order to determine whether they originate from the same missile.

In accordance with an embodiment of the invention, there is still further provided a method, further comprising: detecting and tracking objects that proceed to fly towards protected territory following the punching stage and launching at least one interceptor missile towards at least one of the objects.

In accordance with an embodiment of the invention, there is still further provided a method, wherein (a) includes classifying any tracked suspected inflated object into corresponding inflated object.

In accordance with an embodiment of the invention, there is still further provided a method, wherein the suspected inflated object is classified as an inflated object if it has a flat or substantially flat RCS.

In accordance with an aspect of the invention there is provided a two phase exo-atmospheric intercepting method for intercepting in space multiple objects, comprising:

(i) activating a first phase interception system, including
1. acquiring and tracking inflated objects which fly towards protected territory;
2. classifying the objects into at least one cluster;
3. calculating the flight trajectory of the intercepting missile based on at least the estimated flight trajectory of the target missile or the cluster;
4. uploading pre-launch data to the intercepting missile including the estimated flight trajectory and the planned flight trajectory of the interception missile;
5. launching the intercepting missile and updating its flight trajectory based on at least the relative velocity between the interception missile and the target missile or the cluster;
6. determining succession of timings of ejection of kill vehicles towards respective clusters of objects where each timing is determined upon meeting a corresponding ejection condition;
7. in respect of each ejected kill vehicle, determining timings for releasing at least one salvo of punching objects for punching the inflatable objects;

(ii) activating a second phase interception system for acquiring, tracking and destroying warheads that were concealed within the punched inflated objects and which fly towards the protected area.

In accordance with an aspect of the invention there is provided a two phase exo-atmospheric intercepting method for intercepting in space multiple objects, comprising (a) activating a first phase interception including:
(i) acquiring and tracking multiple inflated objects which fly towards protected territory;
(ii) classifying at least two of the objects into at least one cluster;
(iii) launching an interceptor missile accommodating a plurality of kill vehicles each hosting a plurality of punching objects;
(iv) ejecting at least one kill vehicle towards each cluster and releasing from the vehicle punching objects that are designated to punch the objects of the cluster;
(b) activating a second phase interception, including
(i) acquiring and tracking objects that continue to fly towards the protected area; and
(ii) launching at least one interception missile for destroying the objects tracked in (b)(i).

In accordance with an aspect of the invention there is provided a two phase exo-atmospheric intercepting method for intercepting in space multiple objects, comprising:

(a) activating a first phase interception which is configured to punch in space inflated objects which fly towards a protected territory; and
(b) activating a second phase interception which is configured to destroy warheads that were concealed in the so punched inflatable objects and which fly towards the protected territory.

In accordance with an aspect of the invention there is provided an exo-atmospheric intercepting system for intercepting in space multiple objects, comprising a station configured to acquire and track multiple inflated objects which fly towards a protected territory;

a launcher configured to launch an interceptor missile accommodating a plurality of kill vehicles each hosting a plurality of punching objects; the station being configured to classify the multiple objects into at least one cluster and to communicate the data to the interceptor missile;

the station being configured to determine an ejection condition in respect of each cluster of objects; the station being configured responsive to meeting the condition to command the interceptor to eject a kill vehicle towards the cluster of objects; the kill vehicle is configured to release a plurality of punching objects accommodated therein, such that every inflated object in the cluster is likely, with a high degree of certainty, to be punched by at least one of the punching objects.

In accordance with an embodiment of the invention, there is still further provided a system, the interceptor employing at least one warhead having compartments each accommodating a killing vehicle.

In accordance with an aspect of the invention there is provided a two phase exo-atmospheric intercepting system for intercepting in space multiple objects, comprising a first phase interception system being configured to:

acquire and track multiple inflated objects which fly towards protected territory;

classify at least two of the objects into at least one cluster;

launch an interceptor missile accommodating a plurality of kill vehicles each hosting a plurality of punching objects;

eject at least one kill vehicle towards each cluster and release from the vehicle punching objects that are designated to punch the objects of the cluster;

a second phase interception system, being configured to:

acquire and track objects that continue to fly towards the protected area; and launch at least one interception missile for destroying the tracked objects.

In accordance with an aspect of the invention there is provided a two phase exo-atmospheric intercepting system for intercepting in space multiple objects, comprising:

a first phase interception system which is configured to punch in space inflated objects which fly towards a protected territory; and a second phase interception system which is configured to destroy warheads that were concealed in the so punched inflatable objects and which fly towards the protected territory.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIG. 8B illustrates graphically the physical effect of an object that hits a target;

DETAILED DESCRIPTION OF THE INVENTION

Figure 1:
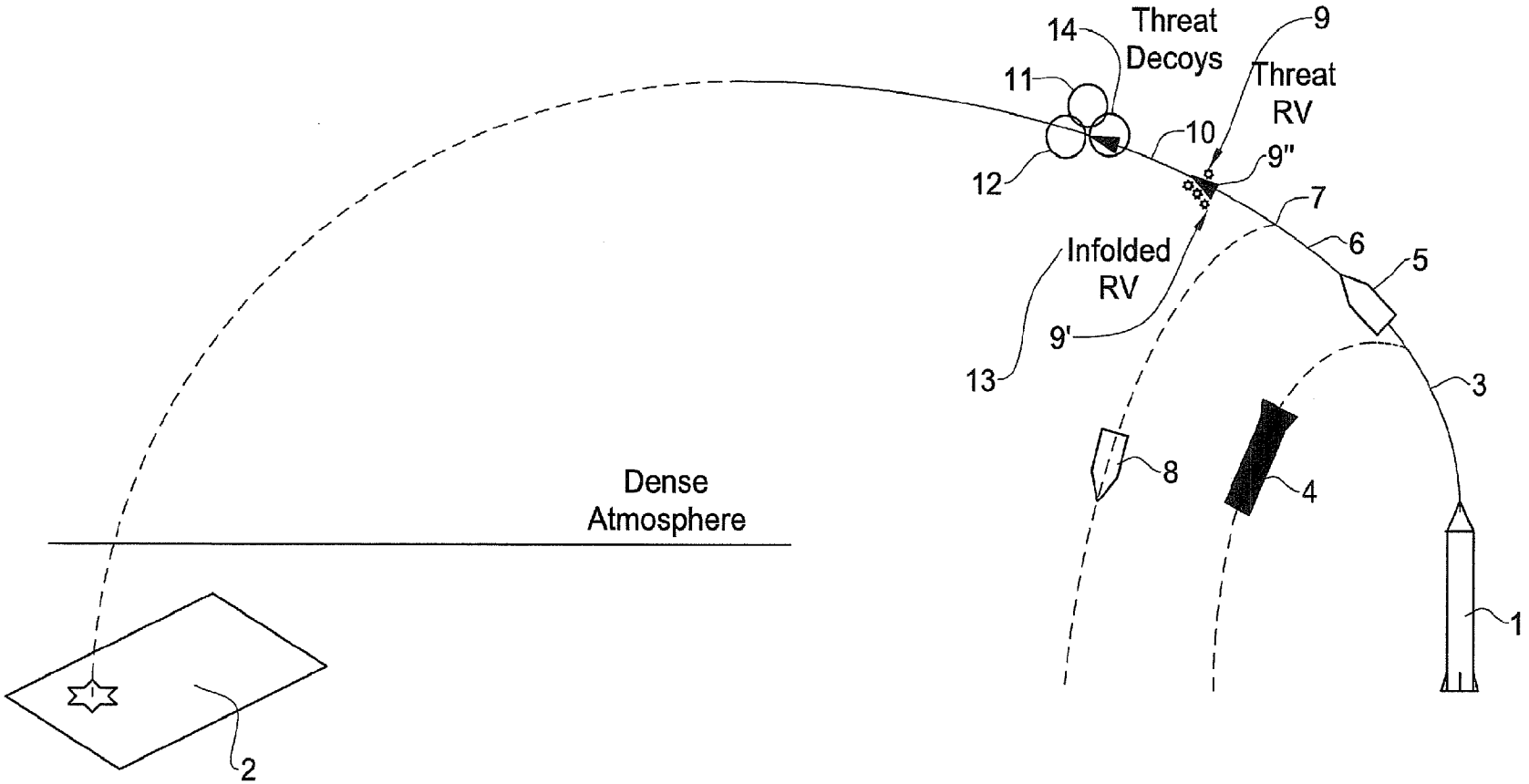
FIG. 1 is a schematic illustration of a battle scene, in accordance with certain embodiments of the invention.

Turning now to FIG. 1, there is shown a schematic illustration of a battle scene, in accordance with certain embodiments of the invention. As shown, a threat, e.g. a ballistic missile 1 is launched towards a friendly territory 2. The ballistic missile undergoes a first stage separation at 3 where the threat booster case 4 and the upper stage portion 5 accelerates and proceeds to fly along the flight trajectory 6. There follows a second separation stage 7 where a threat shroud 8 is discarded and a plurality of inflatable objects 9 continue their flight trajectories. Note that the solid shroud serves for protecting the inflatable objects which may be damaged during the atmospheric and the atmospheric/exo-atmospheric transition flight stages. After having reached the exo-atmospheric stage, the inflatable objects are considerably less vulnerable, and accordingly the protective shroud can be discarded (8). Reverting to FIG. 1, the inflatable objects 9 continue to fly, however they are likely to deviate from the original trajectory 10 due to initial velocity that each is conferred with discarding the protective shroud.

Note that the cluster of inflatable objects includes decoys (designated collectively as 9') and an RV 9". The inflatable objects 9' are inflated (e.g. by utilizing a central pneumatic system or a designated reservoir fitted in each of the objects) upon discarding the shroud and the RV 9" is wrapped with inflatable skin which inflates. The inflated objects, whether a real threat or a decoy, have similar characteristics and have the same RCS (referred to also occasionally also as RF signature) and IR signatures. In accordance with certain embodiments the inflatable objects are balloons.

The initial velocity acquired to each inflatable object will eventually result in that each object flies along a distinct flight trajectory giving rise to a wide spatial spread when the warheads accommodated within inflatable objects eventually hit the protected area 2, thereby hindering a defense system that is designated to intercept them as they re-enter the atmosphere during their final flight stage.

The inflatable objects are either decoys, or they may conceal inside an active RV. For instance, balloons 11 and 12 are decoys whereas balloon 13 conceals an RV 14, obviously having a smaller dimension than the hosting balloon. Note that more than one balloon may accommodate an RV, as the case may be.

In accordance with known multi RV missiles of the kind specified (e.g. the Topol_M system), it is very difficult to discern between a decoy and a real threat (an inflatable object concealing and RV) because the flight characteristics of a decoy and real threat are very similar, namely similar shape, similar Radar Cross Section (RCS) and similar IR signature. Note that an inflatable object that conceals a real threat has the same IR and RF signatures as a dummy inflated object as a result of the special design and material of which the inflatable object is composed. The specified known materials may lock any heat that is dissipated inside the balloon (as a result of the hosted RV) such that the external IR signature is the same as a dummy balloon and likewise the balloon (accommodating an RV) is so designed to have an IR signature that is identical to that of a dummy balloon.

Figure 2A:
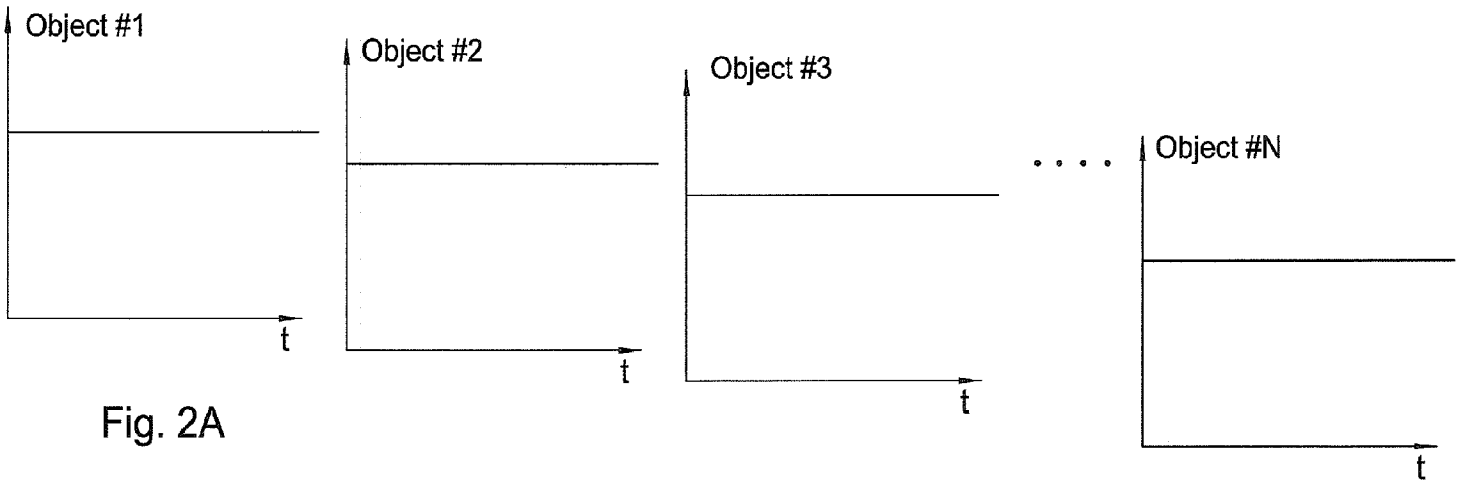
FIG. 2A-B are graphic illustrations of Radar Cross section (RCS) reflections and IR signatures of inflatable objects, in accordance with certain embodiments of the invention.
Figure 2B:
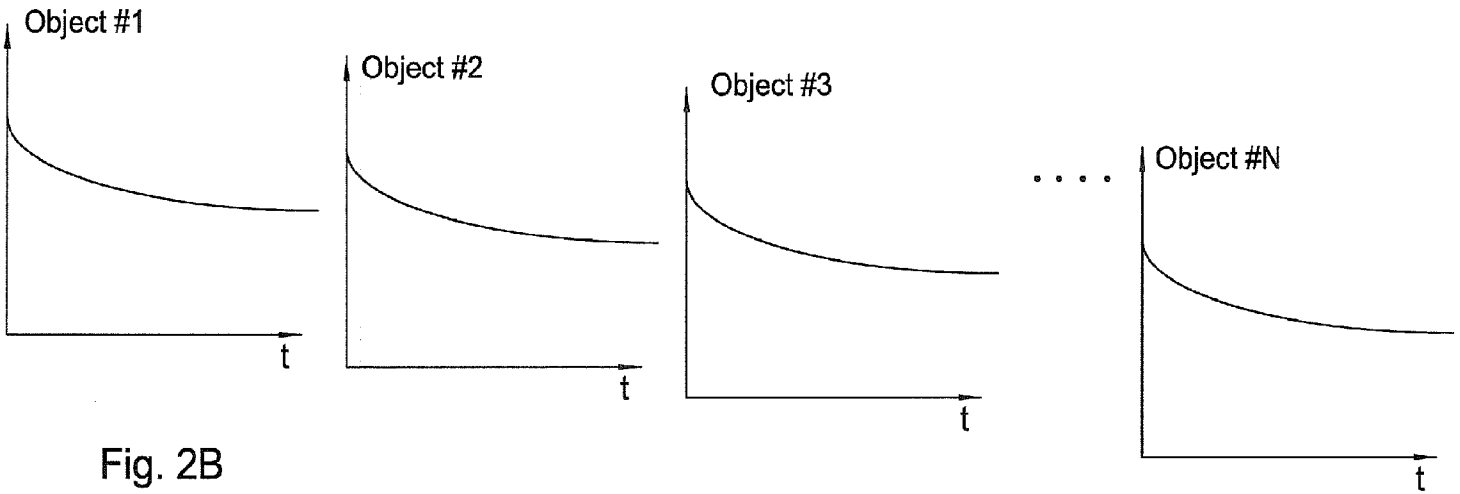

The identical flat RCS of the various objects, whether a decoy or a balloon concealing an RV, is illustrated in FIG. 2A (for inflated objects 1 to N) and likewise identical IR signature is illustrated in FIG. 2B (in respect of the same inflated objects 1 to N)

Note, incidentally, that typically the enemy would launch one or more salvos of missiles each including many inflatable objects of which some are decoys and others are RVs. Typically the defense system cannot send a corresponding number of intercepting warheads each designated towards a given inflatable object, and therefore there is a need, notwithstanding the specified limitations, to discern between a real vehicle and threat.

Note that the invention is not bound by targeting a ballistic missile type of the kind described by way of example only with reference to FIG. 1 and neither by inflatable objects and/or RVs.

Figure 3:
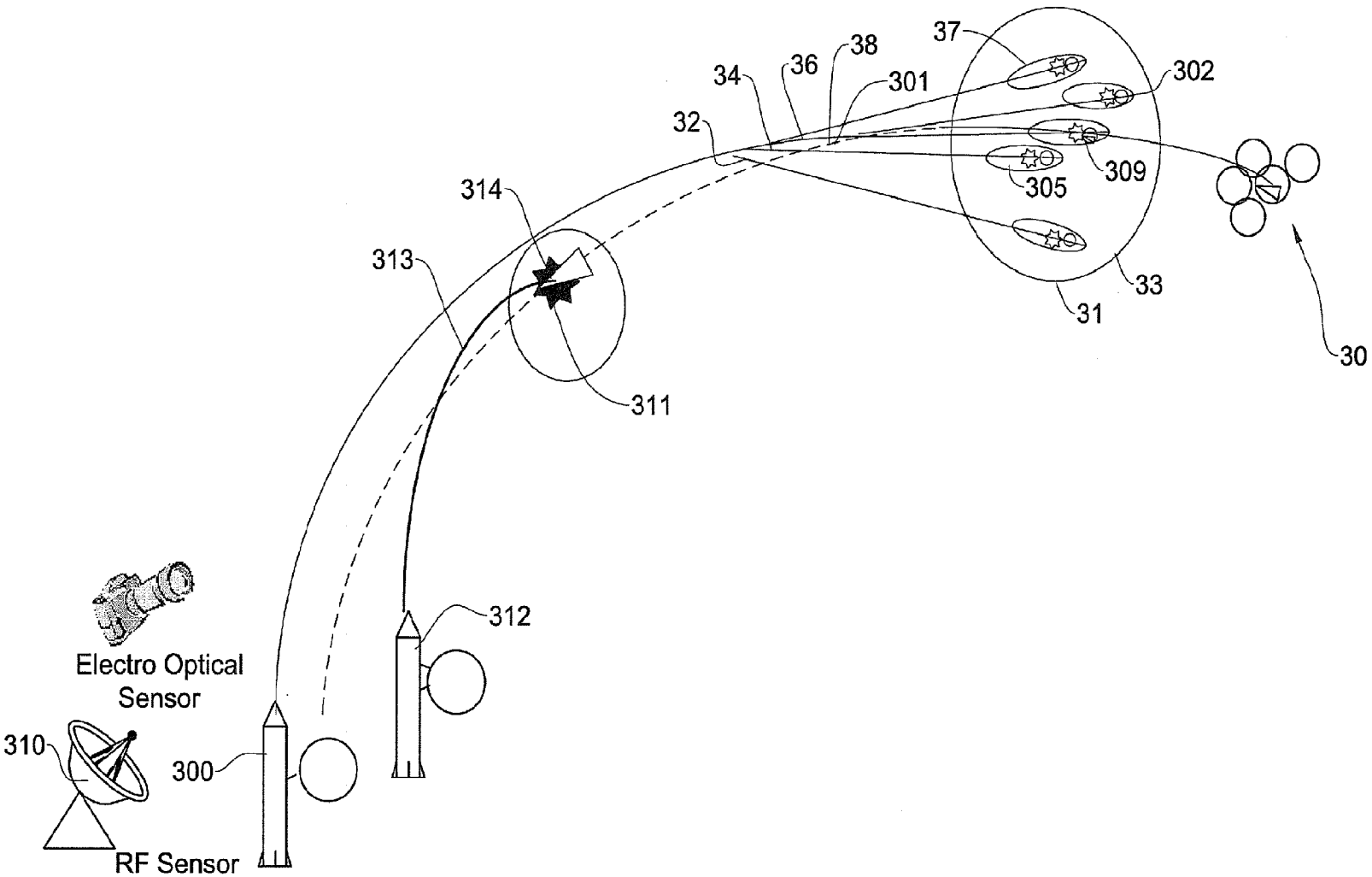
FIG. 3 is a schematic illustration of a defense system's operational stages, in accordance with certain embodiments of the invention.

Turning now to FIG. 3, there is shown a schematic illustration of a defense system's operational stages, in accordance with certain embodiments of the invention. The system illustrated in FIG. 3 is a two phase defense system. As discussed above, the inflated objects are imparted with different velocity vectors, one with respect to the other, such that when eventually they hit the protected territory they will be spaced apart one with respect to the other, hindering, thus, the defense system that is designated to intercept oncoming RVs at the final stage after reentering the atmosphere.

Thus, after having been released from the ballistic missile and after having been inflated, the inflated objects deviate from the original flight trajectory of the ballistic missile, gaining distance one with respect to the other. The fact that the inflated objects are spaced apart one with respect to the other (as shown in area 31) poses an operational constraint in that they cannot be destroyed by a kill vehicle that will release a salvo of punching objects since the latter cannot embrace the entire area of the inflated objects and accordingly a series of kill vehicles should be ejected each designated towards a cluster of one or more inflated objects that reside in a smaller area, all as will be explained in greater detail below. Before moving on it should be noted that the two phase interception system of the invention focuses on inflatable objects because the latter may conceal real warheads. In the case that the so tracked objects are classified as conventional warheads, the latter are subjected to known per se interception techniques that are designated to acquire track and destroy multiple Reentry Vehicle (RV) threats. In accordance with certain embodiments, the discerning between a real warhead and an inflatable object such as a balloon (whether concealing a warhead or not) is determined by the RCS. Thus, an inflatable object may have a flat or substantially flat RCS, whereas a true warhead has a non-flat RCS. Accordingly, by this embodiment, a suspected inflatable object is classified as an inflatable object or not, according to its RCS.

Bearing this in mind, attention is reverted to FIG. 3, where (for example) five distinct kill vehicles are ejected sequentially, each directed towards a different direction for hitting a respective cluster of inflated objects. As shown, a first kill vehicle is ejected from interceptor missile 300 at location 32 and directed towards inflated object 33. A second kill vehicle is ejected from interceptor missile 300 at location 34 and directed towards inflated object 35. A third kill vehicle is ejected from interceptor missile 300 at location 36 and directed towards inflated object 37. A fourth kill vehicle is ejected from interceptor missile 300 at location 38 and designated towards inflated object 39, and a fifth kill vehicle is ejected from interceptor missile 300 at location 301 and designated towards inflated object 303. The ejection timing of the kill vehicle complies with ejection condition, as will be explained in greater detail below.

By this particular example each cluster includes a single inflated object, but those versed in the art will appreciate that the invention is not bound by this particular example.

Note that in accordance with certain embodiments, (i) the detection and tracking of the ballistic missile, (ii) the tracking of the clusters of inflated objects released therefrom, (iii) the calculation of the flying trajectory of the intercepting missile 300 (iv) the calculation of the ejection condition of the kill vehicles towards their respective target cluster of inflated objects, are all performed at the ground station using for instance Radar sensors 310. The data that pertains to the flight trajectory of the intercepting missile 300 as well as the timing data and direction of eject of the kill vehicles from the interceptor missiles, are all communicated to the interceptor missile, using known per se communication means.

After having punched the inflatable object, it appears that one of them concealed an RV 311. Note that the RV 311 could not have been revealed when accommodated within an inflated object, since the latter had substantially identical flight characteristics as the other inflated objects, including by way of example, the same shape, IR signature and RCS. The tracking and destruction of the revealed RV is performed by a second phase defense system. Thus the approaching RV 301 is detected and tracked, and responsive thereto, a second interceptor missile 312 is launched into a collision trajectory for eventually hitting the oncoming RV 311 at interception point 314. Note that the operation of the second phase defense system is generally known per se and therefore will not be expounded upon herein.

Figure 4:
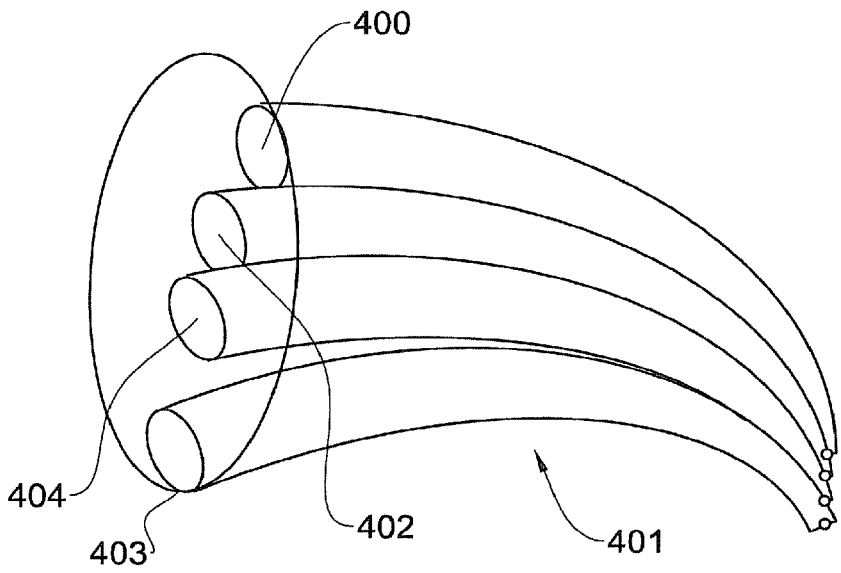
FIG. 4 illustrates schematically uncertainty volume of decoys trajectories in accordance with certain embodiments of the invention.

Turning now to FIG. 4, it illustrates schematically, uncertainty volume of decoy trajectories for a given cluster 400 in accordance with certain embodiments of the invention. As may be recalled, the clusters of inflated objects are tracked, in accordance with certain embodiments, by a ground radar station 310. Considering that the tracked inflated objects are far away from the tracking defense system, there is an inherent uncertainty in their location. For instance, for a distance of 1000 Km (between the ground station and the flying inflated objects), the radar can determine the location of an object with a $10^1$ m accuracy (along the radar's line of sight, hereinafter axis X) and at a degraded accuracy of $10^2$ m along each of the Y,Z axes normal to X, giving rise to a total of location uncertainty volume of $10^5$ $m^3$. Considering that the inflated object size is of the order of 10-100 $m^3$, the net effect is that the object's volume uncertainty is in the order of $10^4$ $m^3$. Thus, from a salvo of $10^4$ punching objects that are released from the kill vehicle towards the specified cluster 400 (and assuming substantially uniform distribution of the punching objects in space), there is a very high likelihood that each inflated object (having at least a volume of 10 $m^3$) is likely to be hit by at least one punching object, which, as will be explained below, will necessarily entail collapse and consequent destruction of the inflated object. In accordance with certain embodiments, a punching object may be a fiber optic element, say a longitudinal fiber optic element, as will be discussed in greater detail below with reference to FIG. 8.

Note, incidentally, that the set of diverging clusters of inflated objects 401 embraces a considerably larger uncertainty volume of the order of $10^7$ $m^3$, and accordingly the prospects of hitting all the inflated objects by one salvo of punching objects is simply infeasible since a single killing vehicle that is ejected from the intercepting missile cannot accommodate such a large number of punching objects. Consequently, in accordance with certain embodiments, in order to destroy all of the inflatable objects, each cluster of inflatable objects is targeted separately. Thus, a first kill vehicle is ejected at a given location and timing, towards cluster 400. The kill vehicle employs a plurality of punching objects which are designated, as explained in detail above, to kill all or substantially all of the inflatable objects that constitute the specified cluster. Thereafter, another killing vehicle is ejected at a specified timing and location towards a different cluster, say 402 and the punching objects accommodated therein are released towards the inflatable objects of cluster 402 for destroying all or substantially all of them. The procedure is then repeated in respect of all other clusters 403 and 404 each time utilizing a different kill vehicle. The end result would then be that all or substantially all of the inflatable objects that originate from the launched ballistic missile (say 2 of FIG. 1) will be destroyed. The ejection timing of the kill vehicle complies with an ejection condition. Note that the numerical examples of FIG. 4 are provided for illustrative purposes only and are by no means binding.

Figure 5:
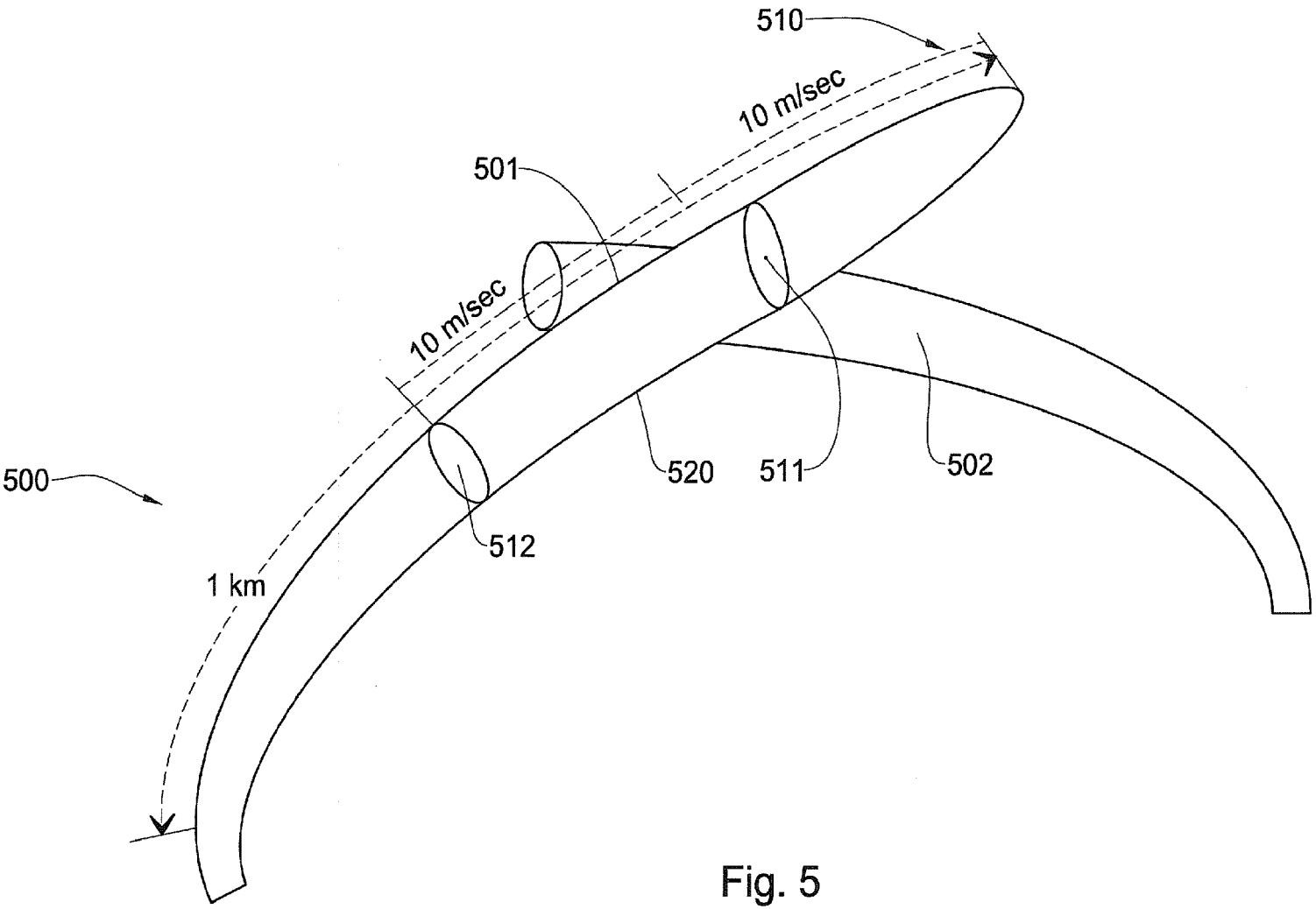
FIG. 5 illustrates schematically a punching objects cloud which crosses via a decoy trajectory, in accordance with certain embodiments of the invention.

Turning now to FIG. 5, it illustrates schematically a punching objects cloud that crosses via a decoy trajectory, in accordance with certain embodiments of the invention. For a better understanding of FIG. 5 it should be noted that in addition to the uncertainty volume (as discussed with reference to FIG. 4), there is an uncertainty time factor that stems from the fact that the velocity estimation of the flying object and that of the approaching punching objects is error prone. In other words, the punching objects trajectory 501 should cross the cluster of inflated objects 502 at the right timing. Assuming that the closing velocity between the intercepting punching objects is 10 Km/sec, then creation of a cloud of about 1 Km 500 would facilitate a time duration of about 100 msec for destroying the inflatable objects constituted by cluster 502. This is achieved by salvos of punching objects, say ten salvos of punching objects each consisting of about $10^4$ punching objects (as explained in detail with reference to FIG. 4) where each bulk is released 10 msec after the other (giving rise to the specified 100 msec time duration). As shown in FIG. 5, assuming that the first bulk (salvo) of $10^4$ punching objects is released at a given timing, it arrives to the interception point at timing 510. In case that it misses (due to uncertainty in time), then the second salvo 511 (of $10^4$ punching objects) that is released 10 msec after the first, may hit the cluster of inflatable objects. If the second salvo also misses, then the third salvo 512 (of $10^4$ punching objects) that is released 10 msec after the second may hit the cluster of inflatable objects, and so forth. It is assumed that within 100 msec, at least one salvo of punching objects will hit the inflatable objects. Accordingly, the sum total of punching objects for killing the inflatable objects should amount for $10^5$ that are released in, say 10 salvos of $10^4$ punching objects each. Those versed in the art will readily appreciate that the numbers outlined with reference to FIGS. 4 and 5 are illustrative only and are by no means binding.

Those versed in the art will readily appreciate that the numeric examples described with reference to FIGS. 4 and 5, are rough estimation values that are provided for illustrative purposes only and are by no means binding.

Figure 6:
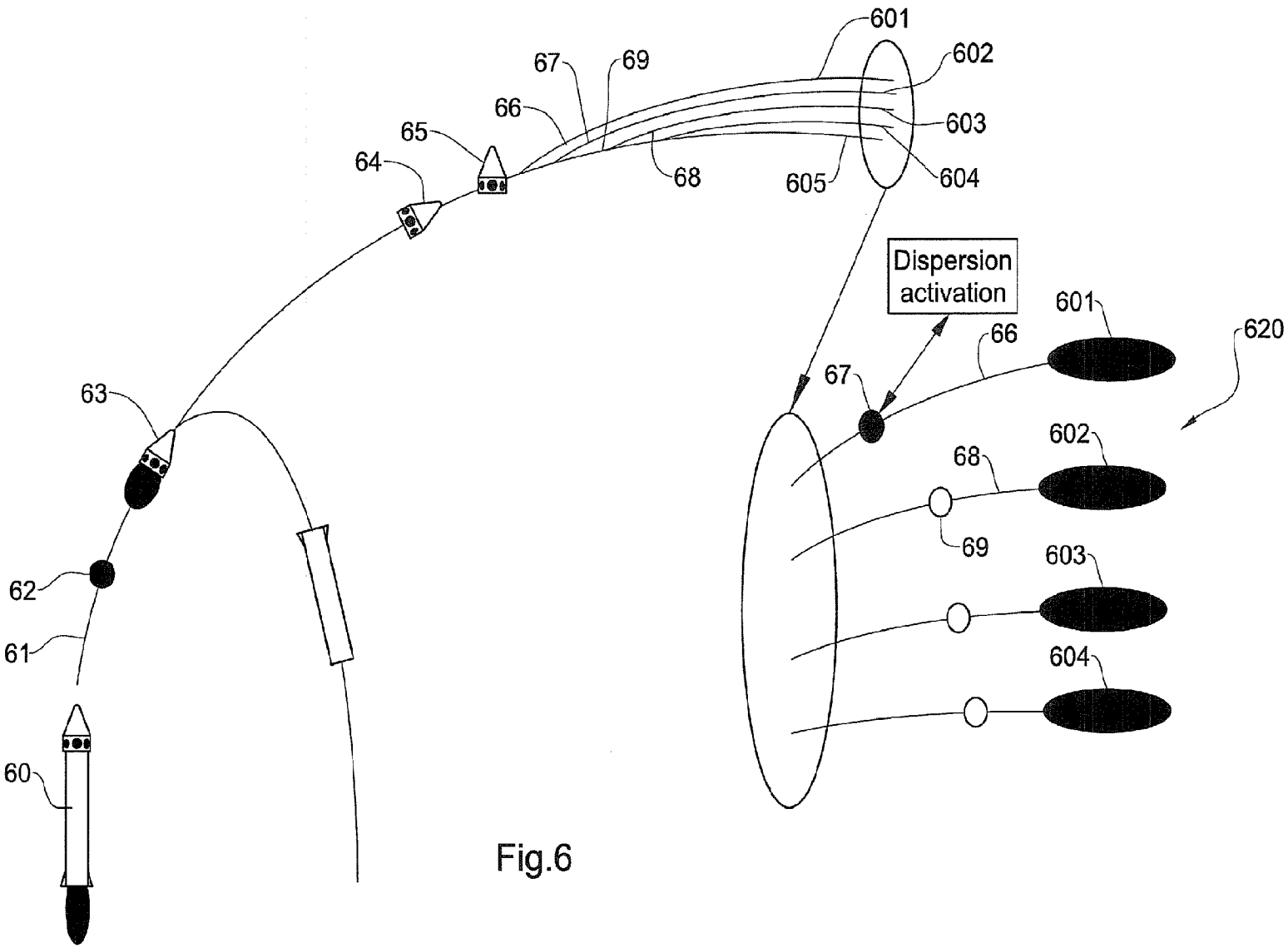
FIG. 6 illustrates schematically a killing scenario, in accordance with certain embodiments of the invention.

Bearing this in mind, attention is drawn to FIG. 6 illustrating schematically a killing scenario, in accordance with certain embodiments of the invention. Whilst not shown in FIG. 6, a ground station detects the launched target missile and triggers the launch of an intercepting missile 60 towards the target missile. The intercepting missile flies along a flight trajectory 61 (designated to hit the target missile or the inflatable objects released therefrom) and undergoes known per se first and second staging (62 and 63), and the warhead 64 continues to fly along the flight trajectory for achieving its kill mission. As will be exemplified in greater detail below, the warhead employs a plurality of kill vehicles each accommodating a bulk of punching objects capable of being released successively for destroying a cluster of inflatable objects. The cluster of inflatable objects (after having been released from the target missile) are illustrated schematically in FIG. 6 as five distinct clusters 601 to 605 respectively, and are also shown in a zoomed out view 620. As described in detail above, there is an uncertain volume of decoy trajectories (discussed with reference to FIG. 4) as well as uncertainty in time as discussed in detail with reference to FIG. 5). This prescribes a mode of operation where each kill vehicle is ejected towards its designated cluster of inflatable objects at an ejected timing in compliance with ejection conditions. The punching objects accommodated within the kill mechanism are released in consecutive salvos so as to generate a cloud of longitudinal punching objects.

It is recalled that there may be an initial stage of classifying suspected inflatable objects into concealing warheads or not, e.g. according to their RCS. The description with reference to FIG. 6 focuses on inflatable objects.

Reverting now to FIG. 6, the warhead continues to fly 64 and at a certain timing needs to eject the kill vehicle towards a designated cluster of inflatable objects. In order to target the first cloud 601, the warhead changes its spatial orientation 65 (depicted in this posture for illustrative purposes only) and deviates to a modified flight trajectory that is required and at a certain timing 67 the kill vehicle is ejected towards the targeted cloud. The modified trajectory 66 and the ejection timing 67 is are also shown in the zoomed out view FIG. 6.

Note that in accordance with certain embodiments, the orientation of the warhead, the determination of modified trajectory and the evaluation of volume and time uncertainty, constitute parameters of the ejection condition for determining the timing of ejecting the kill vehicle. Note that the invention is not bound by the specified parameters and other(s) may be added or certain parameter(s) may be modified or ignored. In accordance with certain embodiments, the determination of the ejection condition is performed at an external station (e.g. a ground station), all as will be explained in greater detail below. Note also that although not shown in the Figs, the warhead may employ, e.g. a known per se ACS (Attitude Control System) which facilitates a motion of the kill vehicle relative to the warhead, thereby allowing a further degree of freedom for orienting the kill vehicle towards its target before it is ejected. The ejection direction of the vehicle towards the target (owing to the ACS that allow orientation of the vehicle relative to the warhead) may facilitate a parameter of the ejection condition.

After having targeted the first cluster 601 (resulting in destroying all or substantially all of the inflatable objects), the second cluster 602 is targeted. This may require re calculation of the ejection condition including time and volume uncertainties as well as re modified flight trajectory, e.g. by virtue of the different relative locations between the warhead and the second cluster 602 and possibly also different closing velocity between the warhead and the flying objects of the second cluster.

The re-modified flight trajectory for the intercepting warhead 68, as the ejection timing and the ejection direction of the second kill vehicle 69 are then determined and communicated from the ground station to the intercepting warhead and are implemented thereby for destroying the inflatable objects of the second cluster. This procedure is repeated in respect of the third to fifth cluster each time determining a different flight trajectory (if necessary) and an ejection timing of the corresponding kill vehicle.

Note that whereas in the various embodiments described herein the term ground station is used, this is only one example of an external station. The latter can be by way of non-limiting example, a space station.

Note that whilst in the embodiments discussed above, the parameters that form part of the stipulation of the ejection timing are the volume and time uncertainties, those versed in the art will readily appreciate that the invention is not bound by these parameters and accordingly the specified parameters may be modified and/or others may be added, all as required and appropriate.

Note also that the description with reference to FIG. 6 above, referred to the scenario that the calculation logic resides in the external (e.g. ground station). In accordance with certain other embodiments certain or all of the logic (including sensors, e.g. radar sensors) for acquiring the inflatable objects' targets are accommodated partially or wholly in the intercepting missile. Note that when part or all of the logic (possibly including sensors) are accommodated in the intercepting missile, this naturally renders the interceptor missile more complex and ecostly. Note also that in the latter case the accuracy of determining the relative spatial position between the CCM (warhead employing the kill vehicles) relative to the CM (inflatable objects) diminishes considering that errors that affect both the CCM and the CM cannot be easily determined, in contrast to the situation where an external station is utilized and can relatively easily detect and eliminate common measuring errors that affect both the CM and the CCM. The latter inaccuracy is reflected in degraded volume/time uncertainty. In an opposite tendency, the mere use of sensors fitted in the interceptor missile may improve the volume/time uncertainty, considering the fact that the distance between the approaching warhead (CCM) and the target inflatable objects is considerably smaller than the distance between the sensors and the inflatable objects (CM), had an external station been used. Assuming that the reduced distance improves the (volume and time) uncertainty, a possible advantage would be, for example, that due to the reduced uncertainty in volume and time, the operational accuracy constraints significantly improve and therefore a considerably smaller number of punching objects would be required for destroying all or substantially all of the inflatable objects that are accommodated in a cluster. This may allow using more kill vehicles, each accommodating less punching objects, thereby allowing one warhead to handle more clusters of inflatable objects.

It is accordingly appreciated that a particular embodiment e.g. where the logic resides in the external (e.g. ground station), or all of the logic (including sensors, e.g. radar sensors) is accommodated partially or wholly in the intercepting missile, is selected depending upon the particular application and possibly operational constraints.

Figure 7B:
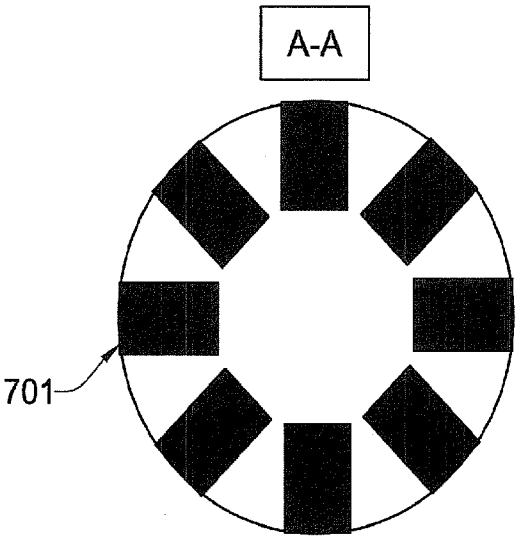
FIG. 7A-B illustrate typical packaging of kill vehicles accommodating each a plurality of punching objects, in accordance with certain embodiments of the invention.
Figure 7A:
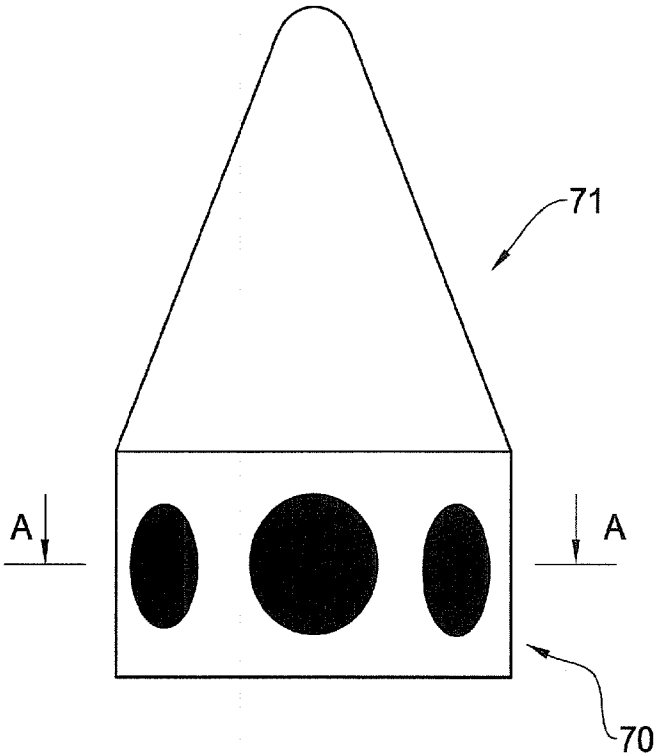

Attention is now drawn to FIG. 7 illustrating a typical packaging of dispensers (kill vehicles) accommodating each a plurality of punching objects, in accordance with certain embodiments of the invention. By this specific example the rear portion 70 of the warhead 71 has compartments each accommodating a killing vehicle (of which three are shown in FIG. 7A). FIG. 7B illustrates a cross section view along A-A where 8 killing vehicles are placed each in a dedicated compartment and are ejected at a timing in compliance with an ejection condition towards the relevant target. The killing vehicles are ejected utilizing know per se ejection means, say pyro technique, mechanical or pneumatic ejection means.

Note that the invention is not bound by the specific architecture of the kill vehicles within the warhead, as depicted in FIG. 7.

Note also that each killing vehicle accommodates a plurality of punching objects that may be placed in neighboring compartments (not shown in FIG. 7) facilitating ejection thereof in consecutive salvos for achieving the cloud of punching objects as described for instance with reference to FIG. 5.

Figure 8A:
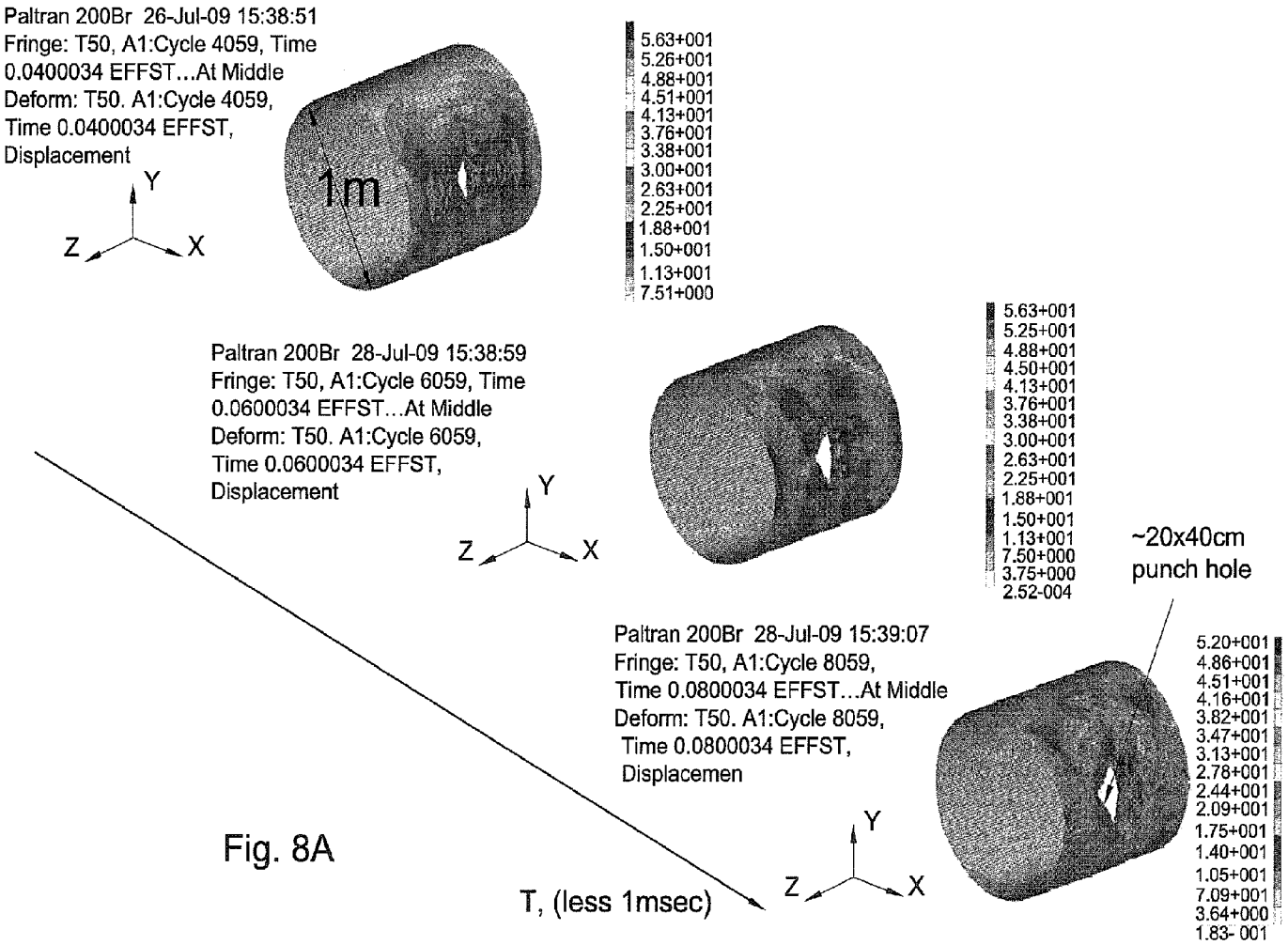
FIG. 8A illustrates graphically a punching and resulting collapse of an inflatable object, in accordance with certain embodiments of the invention.

Attention is now drawn to FIG. 8A, illustrating graphically a sequence of punching and resulting collapse of an inflatable object, in accordance with certain embodiments of the invention. FIG. 8B illustrates graphically the physical effect of an object that hits a target. As shown, when the punching object 81 hits the target 82 (standing for the surface of the inflatable balloon), a crater 83 is generated. The depth dimension $I_C$ of the crater 83 should extend beyond the width of the balloon's skin in order to achieve successful punching. This should be achieved regardless of the orientation of the punching object relative to the target e.g. head-on as illustrated in FIG. 8B (in which case the length dimension $l_P$ of the punching object is taken into account in equation 84) or e.g. when the smaller diameter $d_p$ of the punching object is taken into account in equation 84 (in the latter case $l_P$ is replaced by $d_p$). Note also that the respective densities of the punching object and the balloon's skin affect the crater depth and preferably the punching object's density should be larger than that of the balloon's density.

Figure 9:
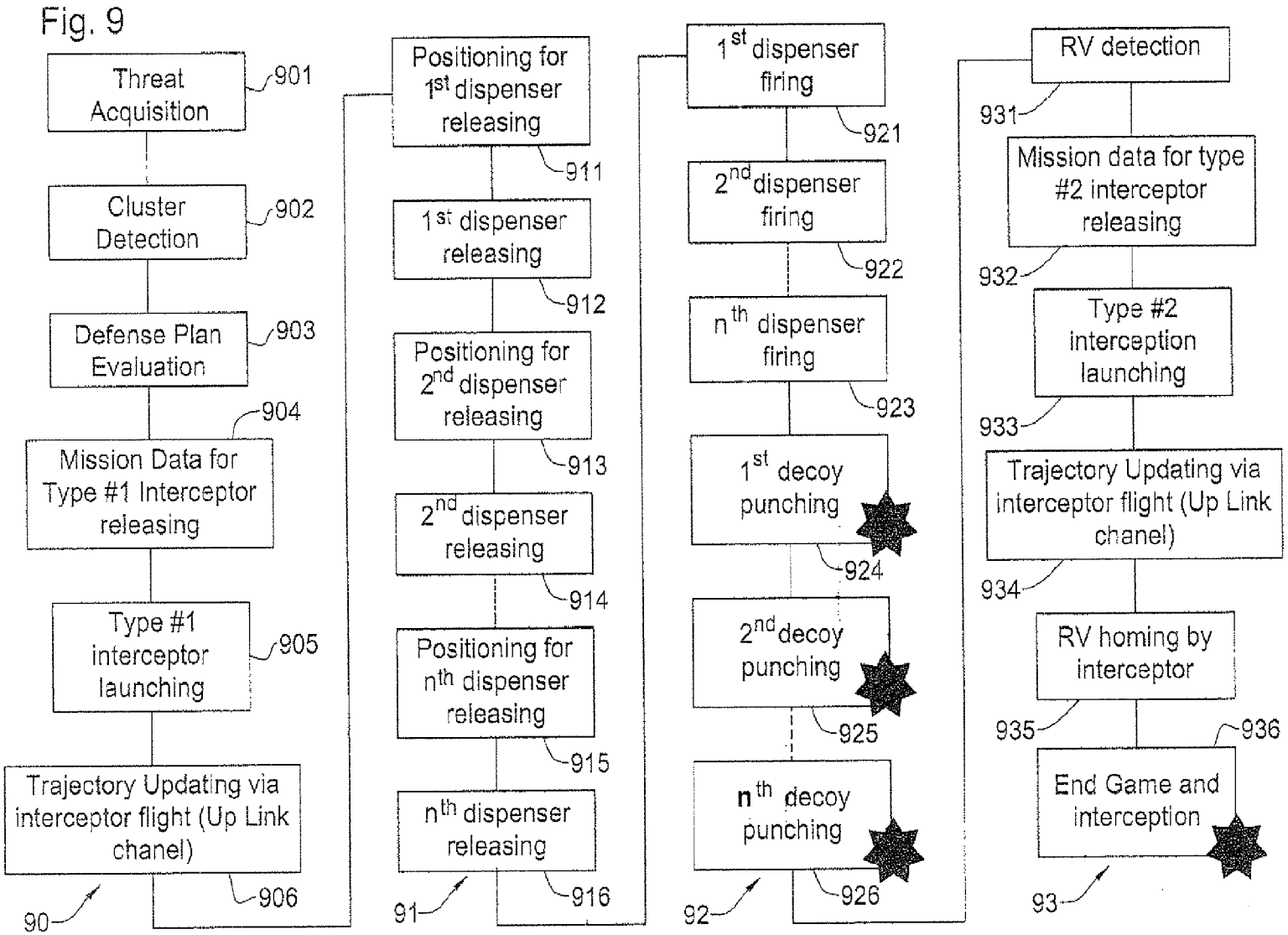
FIG. 9 illustrates a block diagram of a two phase interception defense system, in accordance with certain embodiments of the invention.

Attention is now drawn to FIG. 9 illustrating a block diagram of a two phase interception defense system, in accordance with certain embodiments of the invention. FIG. 9 illustrates the roles performed by the various system components. Thus, the sequence of operational stages 90 are executed by the first phase intercepting system. The sequence of operational stages 91 are executed by the flying intercepting missile. The sequence of operational stages 93 are executed by the kill vehicle and the punching objects accommodated therein, and finally the sequence of operational stages 94 are executed by the second phase interception system.

Note that the invention is neither bound by the split into the various sequences, nor by the stages of each sequence.

Bearing this in mind, the first interception system acquires the target(s) 901 and classifies them into clusters of inflatable objects 902. The acquisition and classification can be performed before releasing of the inflatable objects from the target missile or afterwards. In a scenario where the classification is performed before release, an exemplary logic may dictate that all of the inflatable objects that will be released from the missile will be classified as a single cluster. As may be recalled, there may be an initial stage of classifying suspected inflatable objects into concealing real warheads or not, e.g. according to their RCS. The description with reference to FIG. 9 focuses on inflatable objects.

Reverting to FIG. 9, in step 903, the ground station calculates the flight trajectory of the intercepting missile based, amongst others, on the estimated flight trajectory of the target missile and sends the updates to the interception missile 904. The latter is then launched 905 and flight trajectory updates are communicated thereto based, amongst others, on the relative velocities between the missiles and their spatial locations, all as known per se.

Turning now to sequence 91, the launched platform determines the timing of ejection of the kill vehicle towards the first cluster 911 (upon meeting the ejection condition), based on considerations that were described in detail above, and ejects the kill vehicle 912. Appropriate reorientation, trajectory modification and ejection timing are calculated in respect of the next kill vehicle 913 and the latter is ejected towards the target 914. The procedure is then repeated in respect of additional kill vehicle(s) each targeting another cluster of inflatable objects.

Turning now to sequence 92, at a certain timing the kill vehicle that is flying towards a given cluster of inflatable objects releases a salvo of punching objects 921 and in predefined timings, additional salvos (922, 923) of punching objects are released all as described in detail with reference to FIGS. 4 and 5. It is assumed, with a high degree of certainty, that a salvo of punching objects that collides with inflatable objects of a cluster, will punch them and destroy them (924-926), all as described with reference to FIG. 8.

Having punched the inflatable objects, all those that constitute a decoy will be dispersed in space and pose no threat. The inflatable objects which concealed therein a Reentry Vehicle (RV) will, upon being punched, reveal the RV and the latter will be detected by the second phase interception system 931. The latter operates in a known per se manner for destroying incoming RVs, e.g. plans an interception trajectory and updates and launches the interception missile (932 and 933), Any necessary trajectory updates will be communicated to the launched interception missile 934 followed by known per se homing and end game 935 and 936 stages for destroying the oncoming RV.

Figure 10:
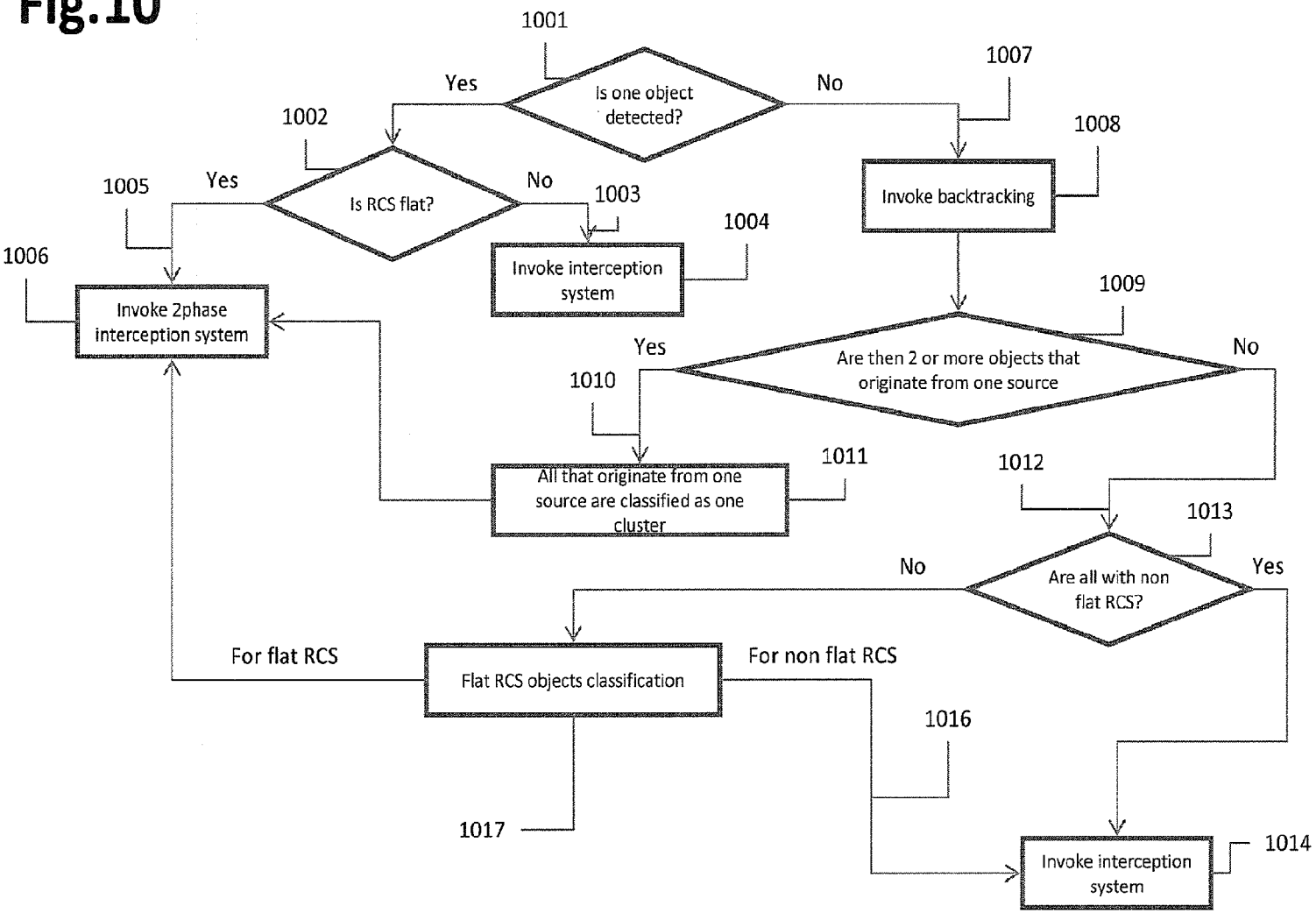
FIG. 10 illustrates a block diagram of a sequence of operation of a two phase interception defense system, in accordance with certain embodiments of the invention.

Turning now to FIG. 10, it illustrates a block diagram of a sequence of operation of a two phase interception defense system, in accordance with certain embodiments of the invention. Thus, at stage 1001 it is inquired whether one object is detected. If in the affirmative 1002, it is tested whether it is a flat or substantially flat RCS 1002. Non flat RCS 1003 indicates that this is a "regular" threat and accordingly a conventional interception system is invoked 1004 where an intercepting missile is launched towards the threat for destroying it. Reverting to inquiry 1002, in the case of flat or substantially flat RCS 1005, this indicates possibly an inflatable object with the risk that it conceals a warhead, and accordingly it is desired to at first punch it, and then destroy the revealed warhead, if any, and to this end a two phase interception sequence is invoked 1006 (of the kind described for example with reference to FIG. 9). Reverting now to inquiry 1001, in a case where more than one object is detected 1007, there commences a known per se backtracking sequence 1008 in order to reveal whether all the objects originate from a given source 1009. In a case where two or more of the revealed objects originate from the same source 1010 (i.e. launched from the same missile), they are all classified as a given cluster 1011 and the objects of each cluster are subjected to invocation of a two phase system of the kind described for example with reference to FIG. 9. Reverting to inquiry 1009, if the objects do not originate from the same source 1012 it is inquired whether they all have non flat RCS.1013. If in the affirmative, this indicates that multiple reentry vehicles (RV) are detected and they should be destroyed using the interception system e.g. designating one interception missile per each detected RV 1014. In a case where a few have non flat RCS and few have flat RCS, the non flat RCS are subjected to conventional interception of the kind discussed above 1016, and the flat RCS objects (possibly inflatable objects concealing warheads) are subjected to the two phase interception system 1017, e.g. the one described with reference to FIG. 9.

Note that the logic described with reference to FIG. 10, may be performed in the external station or partially or wholly in the interception missile, all as required and appropriate. Note also the classification into clusters that were described with reference to FIG. 10 is an example only and accordingly other decision criteria how to classify the objects into clusters may be utilized.

Note also that in accordance with certain embodiments, certain portions of the first and second phase systems may be shared, e.g. the acquiring and tracking means.

Note also that in accordance with certain embodiments certain stages that are performed in the external station may, in other embodiments, be performed at the interceptor missile and vice versa.

As used herein, the phrase "for example," "such as" and variants thereof describing exemplary implementations of the present invention are exemplary in nature and not limiting. Reference in the specification to "one embodiment", "an embodiment", "some embodiments", "another embodiment", "other embodiments" "certain embodiment(s)" or variations thereof means that a particular feature, structure or characteristic described in connection with the embodiment(s) is included in at least one embodiment of the invention. Thus the appearance of the phrase "one embodiment", "an embodiment", "some embodiments", "another embodiment", "other embodiments" "certain embodiment(s)" or variations thereof do not necessarily refer to the same embodiment(s). It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. While the invention has been shown and described with respect to particular embodiments, it is not thus limited. Numerous modifications, changes and improvements within the scope of the invention will now occur to the reader. In embodiments of the invention, fewer, more and/or different stages than those shown in FIG. 9 or 10 may be executed. In embodiments of the invention one or more stages illustrated in FIG. 9 or 10 may be executed in a different order and/or one or more groups of stages may be executed simultaneously. FIG. 9 illustrates a general system architecture in accordance with an embodiment of the invention. The modules in FIG. 9 may be centralized in one location or dispersed over more than one location. In other embodiments of the invention, the system may comprise fewer, more, and/or different modules than those shown in FIG. 9.

Note that the order of the stages in the following Claims are not necessarily binding, for instance the order to stages (b) and (c) in the following Claim 1 may be switched. The same holds true for orders of operations of elements in following system claim.

The present invention has been described with a certain degree of particularity, but those versed in the art will readily appreciate that various alterations and modifications may be carried out without departing from the scope of the following claims:

The invention claimed is:

1. An exo-atmospheric intercepting method for intercepting in space multiple objects, comprising (a) acquiring and tracking multiple inflated objects which fly towards a protected territory;

(b) launching an interceptor missile accommodating a plurality of kill vehicles each hosting a plurality of punching objects;

(c) classifying the multiple objects into at least one cluster; and (d) determining an ejection condition, with respect to each cluster of objects, responsive to meeting of which a kill vehicle is ejected from the interceptor missile towards the cluster of objects and thereafter releasing from the kill vehicle a plurality of punching objects such that every inflated object in the cluster is likely, with a high degree of certainty, to be punched by at least one of the punching objects.

2. The method according to claim 1, wherein the ejection condition includes orientation of the warhead towards the cluster.

3. The method according to claim 1, wherein the ejection condition further includes determination of modified flight trajectory of the interceptor towards the cluster.

4. The method according to claim 1, wherein the ejection condition further includes evaluation of volume uncertainty.

5. The method according to claim 1, wherein the ejection condition further includes evaluation of time uncertainty.

6. The method according to any claim 1, wherein said interceptor employs an Attitude Control System (ACS) that facilitates rotation of the interceptor, constituting a further parameter of ejection condition.

7. The method according to claim 1, wherein said ejection condition prescribes the release timing of the punching object from the kill vehicle.

8. The method according to claim 1, wherein said (c) includes utilizing an external station for classifying the multiple objects into at least one cluster and communicating said cluster data to said interceptor missile.

9. The method according to claim 1, wherein said (d) includes utilizing said external station for determining said ejection condition and communicating said ejection condition data to said interceptor missile, for ejecting said kill vehicle responsive to meeting said ejection condition.

10. The method according to claim 1, wherein said (c) is performed in said interceptor missile.

11. The method according to claim 1, wherein determining said ejection condition is performed in said interceptor missile.

12. The method according to claim 1, wherein said at least one of inflatable objects accommodates a Reentry Vehicle (RV), such that the flight characteristics of said at least one inflatable object resemble the flight characteristics of another inflatable object that does not accommodate an RV.

13. The method according to claim 1, wherein said punching object being longitudinal fiber optics having a density larger than the density of the surface of said inflatable object.

14. The method according to claim 1, wherein said classifying includes, determining at least two objects that are launched from a given platform and classifying them to a cluster of objects.

15. The method according to claim 14, wherein said determining includes performing backtracking to said at least two objects in order to determine whether they originate from the same missile.

16. The method according to claim 1, further comprising: detecting and tracking objects that proceed to fly towards protected territory following said punching stage and launching at least one interceptor missile towards at least one of said objects.

17. The method according to claim 1, wherein said (a) includes classifying any tracked suspected inflated object into corresponding inflated object.

18. The method according to claim 17, wherein said suspected inflated object is classified as an inflated object if it has a flat or substantially flat RCS.

19. A two phase exo-atmospheric intercepting method for intercepting in space multiple objects, comprising:

(a) activating a first phase interception including:
- i. acquiring and tracking multiple inflated objects which fly towards protected territory;
- ii. classifying at least two of said objects into at least one cluster;
- iii. launching an interceptor missile accommodating a plurality of kill vehicles each hosting a plurality of punching objects;
- iv. ejecting at least one kill vehicle towards each cluster and releasing from the vehicle punching objects that are designated to punch the objects of the cluster;

(b) activating a second phase interception, including
- i) acquiring and tracking objects that continue to fly towards the protected area; and
- ii) launching at least one interception missile for destroying the objects tracked in said (b)(i).

20. A two phase exo-atmospheric intercepting method for intercepting in space multiple objects, comprising:

(a) activating a first phase interception which punches inflated objects in space which fly towards a protected territory; and (b) activating a second phase interception which destroys warheads that were concealed in the so punched inflatable objects and which fly towards the protected territory.

21. An exo-atmospheric intercepting system for intercepting in space multiple objects, comprising:

a station configured to acquire and track multiple inflated objects which fly towards a protected territory;

a launcher configured to launch an interceptor missile accommodating a plurality of kill vehicles each hosting a plurality of punching objects;

the station being configured to classify the multiple objects into at least one cluster and to communicate said data to the interceptor missile;

the station being configured to determine an ejection condition in respect of each cluster of objects;

the station being configured responsive to meeting said condition to command said interceptor to eject a kill vehicle towards the cluster of objects;

the kill vehicle being configured to release a plurality of punching objects accommodated therein, such that every inflated object in the cluster is likely, with a high degree of certainty, to be punched by at least one of the punching objects.

22. The system according to claim 21, said interceptor employing at least one warhead having compartments each accommodating a killing vehicle.

23. A two phase exo-atmospheric intercepting system for intercepting in space multiple objects, comprising a first phase interception system being configured to:
- acquire and track multiple inflated objects which fly towards protected territory;
- classify at least two of said objects into at least one cluster;
- launch an interceptor missile accommodating a plurality of kill vehicles each hosting a plurality of punching objects; and
- eject at least one kill vehicle towards each cluster and releasing from the vehicle punching objects that are designated to punch the objects of the cluster; and a second phase interception system, being configured to:
- acquire and track objects that continue to fly towards the protected area; and
- launch at least one interception missile for destroying the tracked objects.

24. A two phase exo-atmospheric intercepting system for intercepting in space multiple objects, comprising:

a first phase interception system which is configured to punch in space inflated objects which fly towards a protected territory; and a second phase interception system which is configured to destroy warheads that were concealed in the so punched inflatable objects and which fly towards the protected territory.

* * * * *